US005975989A

United States Patent [19]

Thiel

[11] Patent Number: 5,975,989

[45] Date of Patent: Nov. 2, 1999

[54] DETAIL TAPE

[76] Inventor: William C. Thiel, 1451 Old Colchester Rd., Oakdale, Conn. 06370

[21] Appl. No.: 09/001,723

[22] Filed: Dec. 31, 1997

[51] Int. Cl.[6] ..... B24B 1/00

[52] U.S. Cl. ..... 451/28; 451/524; 451/539

[58] Field of Search ..... 451/523, 524, 451/525, 557, 533, 539, 532, 536, 28

[56] References Cited

U.S. PATENT DOCUMENTS

| | | | |
|---|---|---|---|
| 4,361,990 | 12/1982 | Link | 51/392 |
| 4,477,938 | 10/1984 | Rogut | 15/118 |
| 4,893,438 | 1/1990 | Fry et al. | 51/394 |
| 4,988,554 | 1/1991 | Paterson et al. | 428/142 |
| 5,056,273 | 10/1991 | Martel et al. | 51/392 |
| 5,176,155 | 1/1993 | Rudolph, Jr. | 132/76.4 |
| 5,616,387 | 4/1997 | Augst et al. | 428/43 |
| 5,691,023 | 11/1997 | Keller | 428/43 |
| 5,712,210 | 1/1998 | Windisch et al. | 442/320 |

*Primary Examiner*—David A. Scherbel
*Assistant Examiner*—Dung Van Nguyen

[57] ABSTRACT

A new detail tape for use with elongate sticks and rods for detailing and polishing hard to reach areas on objects, such as vehicles. The inventive device includes an elongate polishing strip member having a polishing layer, and an adhesive. The polishing layer has front and back faces and comprises a cloth material for polishing a surface. An adhesive is provided on the back face of the polishing layer and is designed for adhering to an object.

7 Claims, 3 Drawing Sheets

DETAIL TAPE

BACKGROUND OF THE INVENTION

1. Field of the Invention

The present invention relates to polishing and detailing accessories and more particularly pertains to a new detail tape for use with elongate sticks and rods for detailing and polishing hard to reach areas on objects, such as vehicles.

2. Description of the Prior Art

The use of polishing and detailing accessories is known in the prior art. More specifically, polishing and detailing accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art polishing and detailing accessories include U.S. Pat. No. 5,373,604; U.S. Pat. No. 5,227,225; U.S. Pat. No. 4,734,320; U.S. Pat. No. 4,992,331; U.S. Pat. No. 5,417,249; and U.S. Patent No. Des. 312,174.

While these devices fulfill their respective, particular objectives and requirements, the aforementioned patents do not disclose a new detail tape. The inventive device includes an elongate polishing strip member having a polishing layer, and an adhesive. The polishing layer has front and back faces and comprises a cloth material for polishing a surface. An adhesive is provided on the back face of the polishing layer and is designed for adhering to an object.

In these respects, the detail tape according to the present invention substantially departs from the conventional concepts and designs of the prior art, and in so doing provides an apparatus primarily developed for the purpose of use with elongate sticks and rods for detailing and polishing hard to reach areas on objects, such as vehicles.

SUMMARY OF THE INVENTION

In view of the foregoing disadvantages inherent in the known types of polishing and detailing accessories now present in the prior art, the present invention provides a new detail tape construction wherein the same can be utilized for use with elongate sticks and rods for detailing and polishing hard to reach areas on objects, such as vehicles.

The general purpose of the present invention, which will be described subsequently in greater detail, is to provide a new detail tape apparatus and method which has many of the advantages of the polishing and detailing accessories mentioned heretofore and many novel features that result in a new detail tape which is not anticipated, rendered obvious, suggested, or even implied by any of the prior art polishing and detailing accessories, either alone or in any combination thereof.

To attain this, the present invention generally comprises an elongate polishing strip member having a polishing layer, and an adhesive. The polishing layer has front and back faces and comprises a cloth material for polishing a surface. An adhesive is provided on the back face of the polishing layer and is designed for adhering to an object.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detail tape apparatus and method which has many of the advantages of the polishing and detailing accessories mentioned heretofore and many novel features that result in a new detail tape which is not anticipated, rendered obvious, suggested, or even implied by any of the prior art polishing and detailing accessories, either alone or in any combination thereof.

It is another object of the present invention to provide a new detail tape which may be easily and efficiently manufactured and marketed.

It is a further object of the present invention to provide a new detail tape which is of a durable and reliable construction.

An even further object of the present invention is to provide a new detail tape which is susceptible of a low cost of manufacture with regard to both materials and labor, and which accordingly is then susceptible of low prices of sale to the consuming public, thereby making such detail tape economically available to the buying public.

Still yet another object of the present invention is to provide a new detail tape which provides in the apparatuses and methods of the prior art some of the advantages thereof, while simultaneously overcoming some of the disadvantages normally associated therewith.

Still another object of the present invention is to provide a new detail tape for use with elongate sticks and rods for detailing and polishing hard to reach areas on objects, such as vehicles.

Yet another object of the present invention is to provide a new detail tape which includes an elongate polishing strip member having a polishing layer, and an adhesive. The polishing layer has front and back faces and comprises a cloth material for polishing a surface. An adhesive is provided on the back face of the polishing layer and is designed for adhering to an object.

Still yet another object of the present invention is to provide a new detail tape that can be adhered around small sticks such as tongue depressors and lollypop stick for providing a convenient tool for cleaning hard to reach areas.

Even still another object of the present invention is to provide a new detail tape that provides a dust free cleaning cloth strip with an adhesive backing for convenient attaching to objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
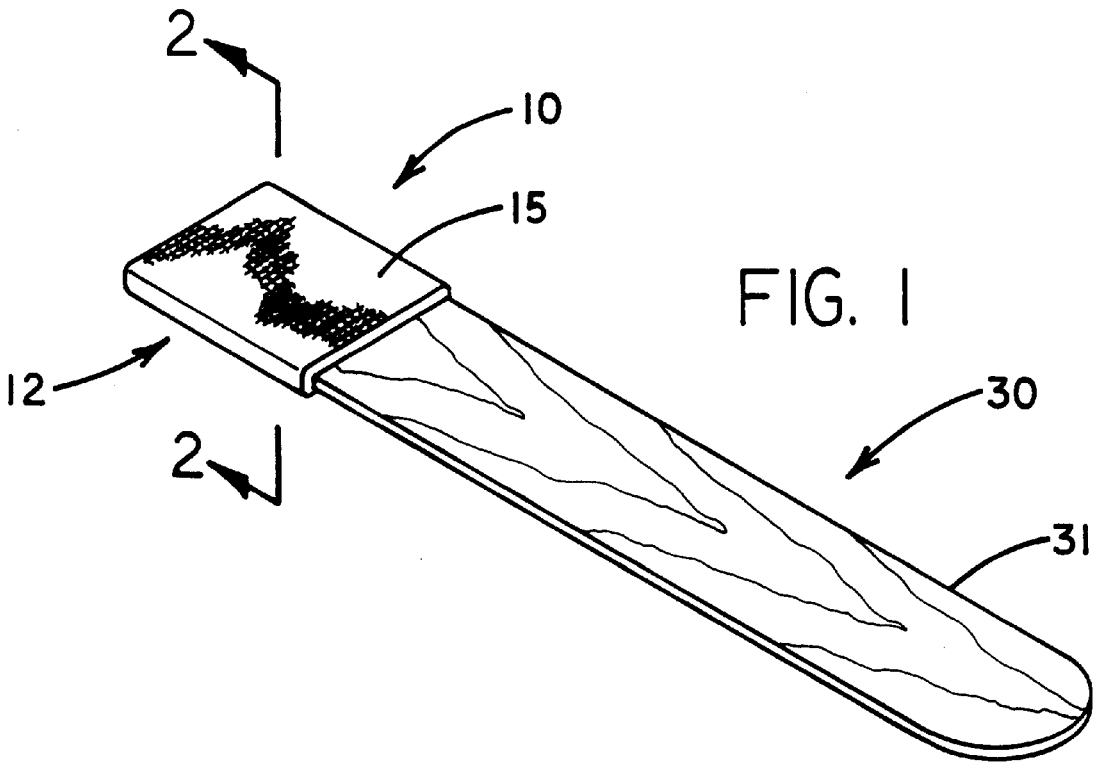
FIG. 1 is a schematic perspective view of a new detail tape in use wrapped around a stick according to the present invention.

With reference now to the drawings, and in particular to FIGS. 1 through 5 thereof, a new detail tape embodying the principles and concepts of the present invention and generally designated by the reference numeral 10 will be described.

As best illustrated in FIGS. 1 through 5, the detail tape 10 generally comprises an elongate polishing strip member 12 having a polishing layer 14, and an adhesive 18. The polishing layer has front and back faces 15,16 and comprises a cloth material for polishing a surface. An adhesive 18 is provided on the back face 16 of the polishing layer 14 and is designed for adhering to an object.

Figure 5:
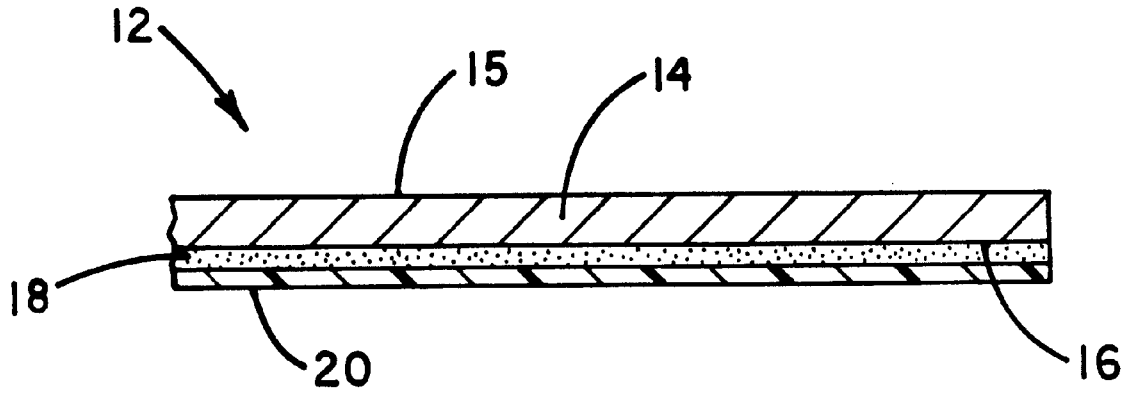
FIG. 5 is a schematic cross-sectional view of the present invention with a back strip.

As shown in FIG. 5, the polishing strip member 12 preferably includes a polishing layer 14, an adhesive 18, and a backing strip 20. The polishing layer 14 has front and back faces 15,16, with the front face 15 of the polishing layer 14 designed for polishing a surface, such as the exterior of a vehicle. The polishing layer 14 is made from a cloth material that preferably is a substantially dust-free polishing cloth material. The adhesive 18 is provided on the back face 16 of the polishing layer 14. As shown in FIG. 5, the adhesive 18 is interposed between the polishing layer 14 and the backing strip 20. The adhesive 18 removably adheres the backing strip 20 to the back face 16 of the polishing layer 14. The adhesive 18 is designed for adhering to an object. Preferably, the adhesive 18 is a pressure sensitive adhesive that adheres to a surface when pressure is applied thereto.

Figure 3:
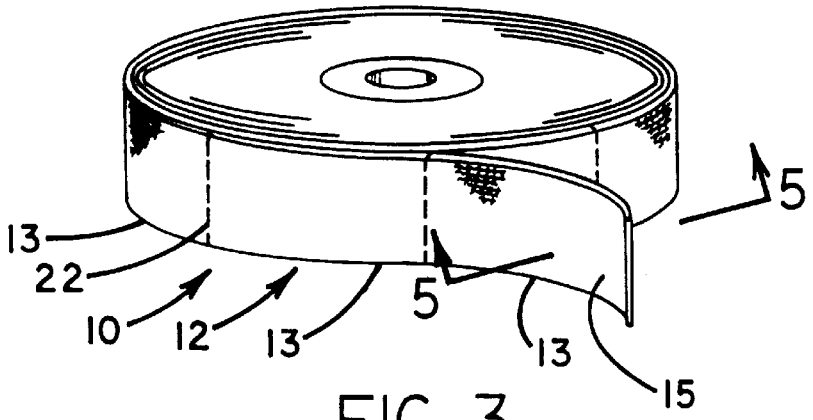
FIG. 3 is a schematic perspective view of a roll of the present invention.

Ideally, the polishing strip member 12 is divided into a series of separable generally rectangular portions 13. Preferably, in this ideal embodiment, the polishing strip member 12 has a plurality of perforations 22 between each portion 13 of the polishing strip member 12 for aiding separation of the portions 13 of the polishing strip member 12 from one another. As shown in FIG. 3, the polishing strip member 13 is rolled into a generally cylindrical roll.

Figure 4:
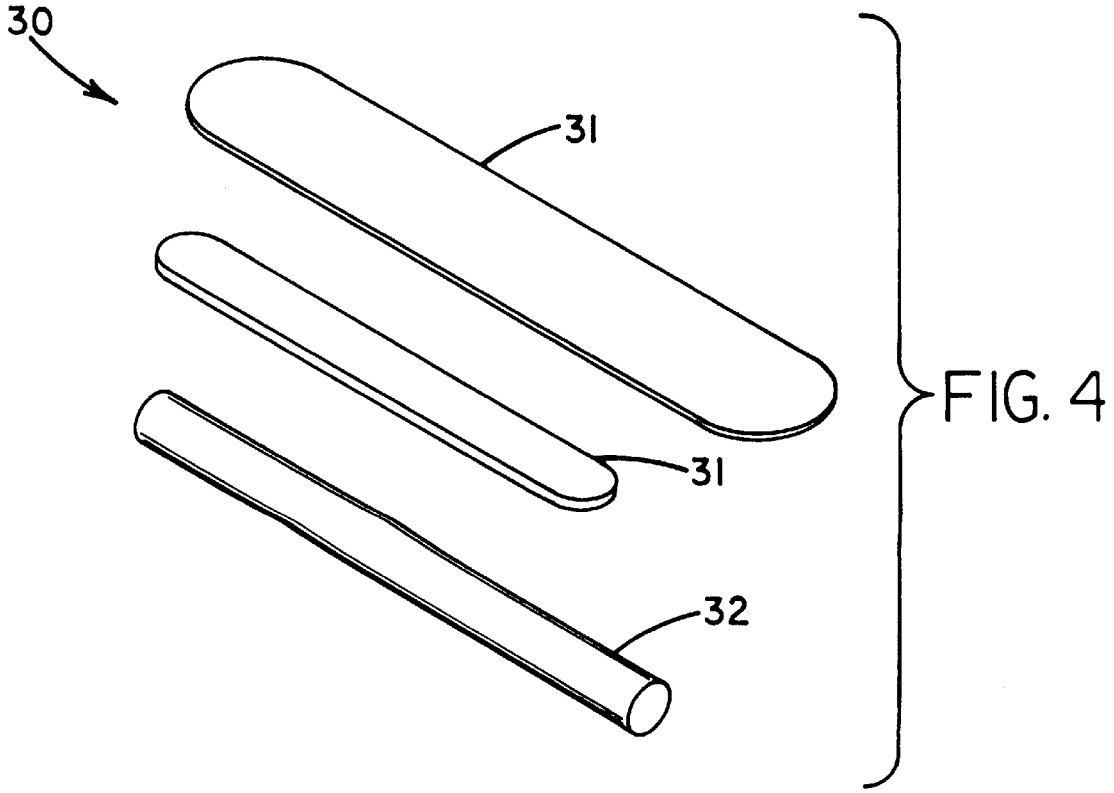
FIG. 4 is a schematic perspective view of various stick members of the present invention.

In use, the detail tape 10 is used for polishing or detailing surfaces of objects that are difficult to access or reach, such as the nocks and crannies of the exterior of a vehicle. Generally a stick member 30 having opposite terminal ends is first provided. The stick member 30 can be any shape appropriate for the area to be polished. One option is that the stick member 31 provided is tongue depressor shaped with substantially flat having substantially planar first and second surfaces. As shown in FIG. 4, this flat stick member 31 may be variously sized. Another option, is that the stick member 32 provided is generally cylindrical such a lollypop stick.

Figure 2:
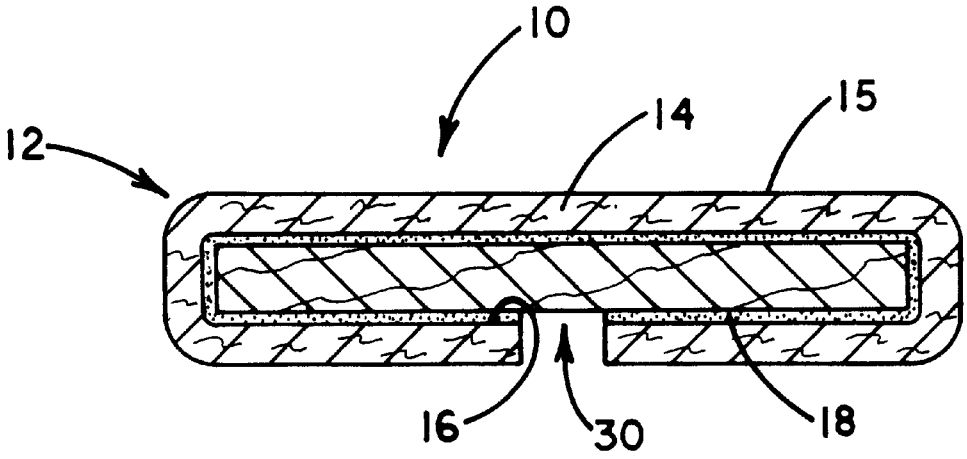
FIG. 2 is a schematic cross-sectional view of the present invention wrapped around a stick.

The next step is to attach the detailing tape 10 to the stick member 30 as shown in FIGS. 1 and 2. First, if a roll of the tape is used, then a portion of the polishing strip member 12 is detached from the rest of the portions of the polishing strip member. Next, the backing strip 20 is removed from the back face 16 of the polishing layer 14 to expose the adhesive 18 of the polishing strip member 12. While the polishing strip member 12 is positionable anywhere along the length of the stick member 30, preferably the polishing strip member 12 is positioned towards one end of the stick member 30 as shown in FIG. 1. The back face 16 of the polishing layer 14 is positioned adjacent the stick member 30 so that a portion of the back face 16 may be adhered to the stick member 30 with the adhesive 18. The polishing strip member 12 may then be wrapped around the stick member 20 such that the front face 15 of the polishing layer is facing outwards around the end of the stick member 30. The other the end of the stick member 30 may then be grasped so that the end of the stick member with the polishing strip member 12 may be manipulated to polish a surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for polishing a surface of an object, comprising the steps of:

providing an elongate stick member having opposite ends;

providing a detailing tape;

wherein said detailing comprises:

an elongate polishing strip member having a polishing layer and an adhesive;

said polishing layer having front and back faces, said polishing layer comprising a cloth material, wherein said cloth material is a substantially dust-free cloth material, said front face of said polishing layer being for polishing a surface therewith; and said adhesive being provided on said back face of said polishing layer, wherein said adhesive is a pressure sensitive adhesive that adheres to a surface when pressure is applied thereto;

wrapping said polishing layer around said stick member such that said polishing strip member is adhered to said end of said stick member;

grasping the other said end of said stick member; and polishing a surface with said top face of said polishing layer of said polishing strip wrapped around said end of said stick member.

2. The method of claim 1, wherein the step of wrapping said polishing layer of said stick member further includes the steps of:

positioning said polishing strip member towards one end of said stick member;

positioning said back face of said polishing layer of said polishing strip member adjacent said stick member; and adhering a portion of said back face of said polishing layer of said polishing strip member to said stick member with said adhesive.

3. The method of claim 1, wherein said stick member provided is substantially flat having substantially planar first and second surfaces.

4. The method of claim 1, wherein said stick member provided is generally cylindrical.

5. The method of claim 1, wherein polishing strip further includes a backing strip, said adhesive being interposed between said polishing layer and said backing strip, said adhesive removably adhering said backing strip to said back face of said polishing layer.

6. The method of claim 5, further comprising the steps of:

removing said backing strip from said back face of said polishing layer to expose said adhesive;

wrapping said polishing layer around said stick member such that said polishing strip member is adhered to said end of said stick member;

grasping the other said end of said stick member; and polishing a surface with said top face of said polishing layer of said polishing strip wrapped around said end of said stick member.

7. A method for polishing a surface of an object, comprising the steps of:

providing an elongate stick member having opposite ends;

providing a detailing tape;

wherein said detailing comprises:

an elongate polishing strip member having a polishing layer, an adhesive, and a backing strip;

said polishing layer having front and back faces, said polishing layer comprising a cloth material, wherein said cloth material is a substantially dust-free cloth material, said front face of said polishing layer being for polishing a surface therewith;

said adhesive being provided on said back face of said polishing layer, said adhesive being interposed between said polishing layer and said backing strip, said adhesive being for adhering to an object, wherein said adhesive is a pressure sensitive adhesive that adheres to a surface when pressure is applied thereto; and said adhesive removably adhering said backing strip to said back face of said polishing layer;

removing said backing strip from said back face of said polishing layer to expose said adhesive of said polishing strip;

positioning said polishing strip member towards one end of said stick member;

positioning said back face of said polishing layer of said polishing strip member adjacent said stick member;

adhering a portion of said back face of said polishing layer of said polishing strip member to said stick member with said adhesive;

wrapping said polishing layer around said stick member such that said polishing layer such that said polishing strip member is adhered to said end of said stick member;

grasping the other said end of said stick member; and polishing a surface with said top face of said polishing layer of said polishing strip wrapped around said end of said stick member.

* * * * *